US006320483B1

(12) United States Patent
Raty et al.

(10) Patent No.: US 6,320,483 B1
(45) Date of Patent: Nov. 20, 2001

(54) MULTI SURFACE COUPLED COAXIAL RESONATOR

(75) Inventors: Tuomo Raty; Antti Kanervo, both of Raahe (FI)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/539,435

(22) Filed: Mar. 30, 2000

Related U.S. Application Data

(63) Continuation of application No. PCT/EP98/05410, filed on Aug. 26, 1998.

(30) Foreign Application Priority Data

Sep. 30, 1997 (FI) ..... 973842

(51) Int. Cl.[7] ..... H01P 1/202; H01P 1/205; H01P 7/04

(52) U.S. Cl. ..... 333/207; 333/203; 333/223

(58) Field of Search ..... 333/202, 203, 333/206, 207, 208, 209, 212, 222, 223, 224, 230, 231, 232, 235

(56) References Cited

U.S. PATENT DOCUMENTS

| | | | | |
|---|---|---|---|---|
| 3,020,500 | | 2/1962 | Beiser | 333/226 |
| 4,292,610 | | 9/1981 | Makimoto et al. | 333/222 |
| 4,437,076 | * | 3/1984 | Makimoto et al. | 333/206 |
| 5,418,509 | * | 5/1995 | Piirainen | 333/203 |
| 6,198,363 | * | 3/2001 | Vuoppola et al. | 333/202 |

FOREIGN PATENT DOCUMENTS

| | | | |
|---|---|---|---|
| 532864 | | 1/1973 | (CH) . |
| 1918356 | * | 10/1970 | (DE) . |

OTHER PUBLICATIONS

Patent Abstracts of Japan, vol. 9, No. 240 & JP 60 090402 A (Nippon Denki K.K.), Sep. 26, 1985.

* cited by examiner

*Primary Examiner*—Robert Pascal
*Assistant Examiner*—Barbara Summons
(74) *Attorney, Agent, or Firm*—Jacobson Holman, PLLC

(57) ABSTRACT

The invention relates to an air-insulated coaxial resonator, which is particularly suitable for a structural part in duplex filters. The resonator has an inner conductor (301) extended at one end, so that it forms extra capacitance with the cover (303) of the resonator and the upper part (302*y*) of the outer conductor. Because of the extra capacitance, a resonator of a certain frequency is shorter than a corresponding quarter-wave resonator. Because of this it is also mechanically stronger and is more stable in its properties. The extension of the inner conductor and the shortening of the construction also have a dissipation-reducing effect. The extension (304, 305, 306*a*, 306*b*) can also be used for tuning the resonator and for coupling to the adjacent circuit elements. In a construction according to the invention, a third harmonic of the basic frequency component does not occur, which is a remarkable advantage in the manufacture of filters.

10 Claims, 2 Drawing Sheets

MULTI SURFACE COUPLED COAXIAL RESONATOR

The instant application is a continuation of PCT/EP98/05410 filed Aug. 26, 1998.

TECHNICAL FIELD

The invention relates to a resonator defined in the preamble of Claim 1, which is particularly suitable for a structural part of duplex filters in radio devices.

BACKGROUND OF THE INVENTION

Resonators are used as the main structural part in the manufacture of oscillators and filters. The important characteristics of resonators include, for example: (Q-value), size, tunability, tendency to oscillate at the harmonic frequencies, mechanical stability, temperature and humidity stability and manufacturing costs.

The resonator constructions that are known so far include the following:

1) Resonators compiled of discrete components, such as capacitors and inductors

Resonators of this kind entail the drawback of internal dissipation of the components and therefore clearly lower Q-values compared to the other types.

2) Microstrip resonators

A microstrip resonator is formed in the conductor areas on the surface of a circuit board, for example. The drawback is radiation dissipation caused by the open construction and thus relatively low Q-values.

3) Transmission line resonators

In a transmission line resonator, the oscillator consists of a certain length of a transmission line of a suitable type. When a twin cable or coaxial cable is used, the drawback is relatively high dissipation and a relatively poor stability. When a waveguide is used, stability can be improved, but the dissipation is still relatively high because of radiation when the end of the pipe is open. The construction can also be unpractical large. A closed, relatively short waveguide resonator is regarded as a cavity resonator, which is dealt with later.

4) Coaxial resonators

Resonators of this type have a construction which is not merely a piece of coaxial cable but a unit which was originally intended as a resonator. FIG. 1 shows a coaxial resonator. It includes, among other things, an inner conductor 101 and an outer conductor 102, which are air-insulated from each other, and a conductive cover 103, which is connected with the outer conductor. A relatively good result can be achieved by this construction. The length of the resonator 1 is at least one fourth, $\lambda/4$, of the wavelength of the variable field effective in it, which is a drawback when aiming at minimizing the size. The width can be reduced by reducing the sides D of the outer conductor and the diameter d of the inner conductors. However, this leads to an increase of resistive dissipation. In addition, because of the reduction in the thickness of the construction, it may be necessary to support the inner conductor by a piece 107 made of a dielectric material, which causes considerable extra dissipation in the form of dielectric loss and increases the manufacturing costs. Furthermore, a drawback of the known coaxial resonators is a tendency to oscillate at the third harmonic of the basic frequency. This extra component (spectrum when the signal is transferred) is so strong that it must be removed by a separate filter.

A filter comprising coaxial resonators is disclosed in Swiss Patent No 532 864, having a capacitive coupling between adjacent coaxial resonators. The capacitive coupling between the resonators may be adjusted.

An other filter comprising coaxial resonators is disclosed in Japan publication JP 60090402, each resonator having an arm extending in the propagation direction of a transmit signal to increase the capacitive coupling between the inner conductor and the outer conductor.

5) Helix-resonators

This type is a modification of a coaxial resonator, in which the cylindrical inner conductor is replaced by a helical conductor. Thus the size of the resonator is reduced, but the clearly increased dissipation is a drawback. Dissipation is due to the generally small wire diameter of the inner conductor.

6) Cavity resonators

Resonators of this type are hollow pieces made of a conductive material, in which electromagnetic oscillation can be excited. The resonator can be rectangular, cylindrical or spherical in shape. Very low dissipation can be achieved with cavity resonators. However, their size is a drawback when the aim is to minimize the size of the construction. In addition, the tunability of most cavity resonators is poor.

7) Dielectric resonators

Coaxial cables or a closed conducting surface is formed on the surface of the dielectric piece. The advantage is that the construction can be made in a small size. Relatively low dissipation can also be achieved. On the other hand, dielectric resonators have the drawback of relatively high manufacturing costs.

8) Hat resonators

A subclass of coaxial resonators, here called hat resonators, are described in U.S. Pat. No. 4,292,610 by Makimoto. This type of resonators is a cavity resonator, as described above, with an additional disc on the open end of the waveguide, having a larger diameter than the waveguide. An advantage is that the resonator can be made compact. Relatively low dissipation can also be achieved. The surface of the disc and distances to the walls of the resonator are dimensioned so that due to extra capacitance created between the disc and the cavity, the resonator can be made substantially smaller compared to one without the additional disc.

SUMMARY OF THE INVENTION

The purpose of the invention is to minimise the above mentioned drawbacks of the prior art. A coaxial resonator according to the invention is characterised in what is set forth in the independent claim. Some preferred embodiments of the invention are set forth in the dependent claims.

The basic idea of the invention is the following: The construction is a coaxial resonator, open at one end and shortened from a quarter-wave resonator. The shortening is carried out by creating air-insulated extra capacitance by means of a mechanical structure at the open end of the resonator between the inner and outer conductor and between the inner conductor and the resonator cover.

The invention has the advantage that because of the manner of increasing the capacitance, the resonator can be made substantially smaller than a prior art quarter-wave resonator, which has the same Q-value. The improvement achieved can also be used partly for saving space and partly for maintaining a high Q-value compared to the Q-value for a resonator with a single top capacitance, such as a tuning screw.

Furthermore, a smaller resonator according to the present invention has the advantage to allow the volume of the cavity to be substantially smaller for a specific frequency, compared to previous resonator constructions, described above.

In addition, the invention has the advantage that a resonator according to it does not oscillate at the third harmonic of the basic frequency. The fifth harmonic is the first notable impurity, and to filter that, as well as the upper harmonics, is much simpler than to filter the third harmonic that occurs in the prior art resonators.

In addition, the invention has the advantage that when the resonator is shortened, it becomes mechanically stronger and therefore also more stable with regard to its electrical properties. Support pieces that increase the dissipation are not needed in it, either.

Furthermore, the invention has the advantage that the structure that increases capacitance can also be used for tuning the resonator and for connecting it to other circuit elements, so that the number of components required by these functions is reduced.

Furthermore, the invention has the advantage that the manufacturing costs of the resonator are relatively small.

BRIEF DESCRIPTION OF THE DRAWINGS

In the following, the invention will be described in more detail with reference to the accompanying drawings, in which.

PREFERRED EMBODIMENTS

Figure 1A:
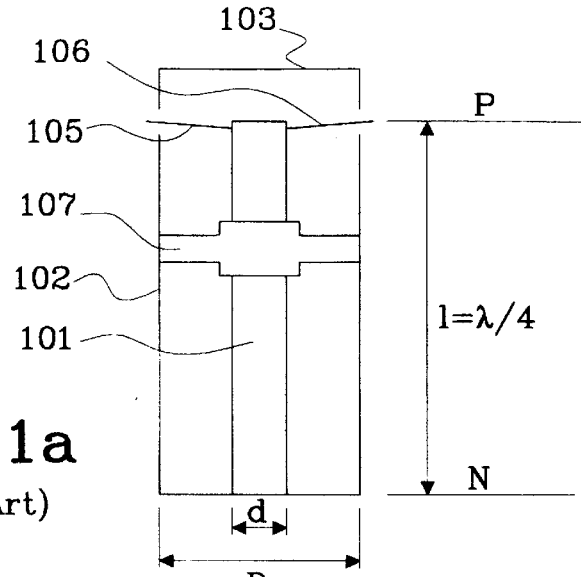
Fig. 1a (Prior Art)
FIG. 1*a* shows a vertical section of a prior-art coaxial resonator.

The coaxial resonator shown in FIG. 1 was already briefly described in connection with the prior art description above. If the resonator in question is made for the 900 MHz frequency, for example, the length 1 of the resonator is approx. 8 cm. The side D of the outer conductor and the diameter d of the inner conductor can be selected according to the amount of dissipation permitted. However, there is an optimum value for the ratio D/d, about 3, which maximizes the Q-value, if the wave form is TEM. In FIGS. 1*a* and 1*b,* two thin metal strips 105, 106, are also fastened to the inner conductor, by which strips the capacitive connection to the resonator and forward is carried out. The connection could also be inductive, in which case it would have to be made at the lower end of the resonator. The tuning of a resonator according to FIG. 1 is often carried out by means of a screw fastened to the resonator cover, which screw forms a small, adjustable capacitance with the inner conductor.

Figure 1C:
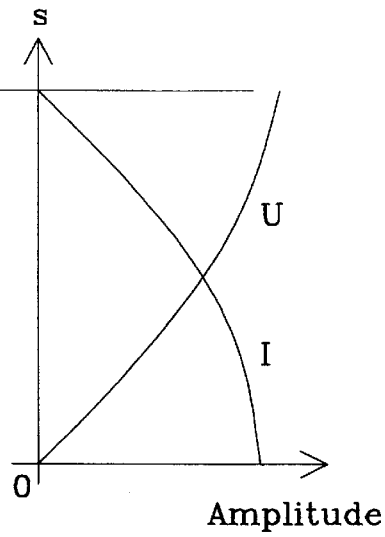
Fig. 1c (Prior Art)
FIG. 1*c* shows the change in the intensity of the current and voltage in the resonator of FIG. 1*a,*
Figure 1B:
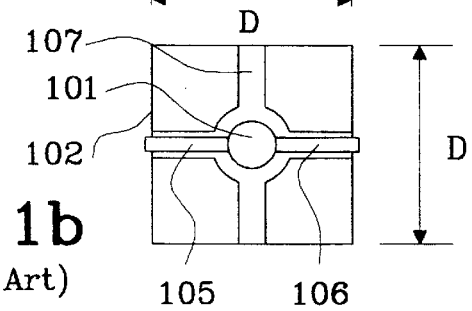
Fig. 1b (Prior Art)
FIG. 1*b* shows a lateral section of the resonator of FIG. 1*a,*

FIG. 1*c* shows the alternating current I that runs in the conductors of the resonator and the alternating voltage U between the conductors as a function of the location s. The current I is at the highest at the shorted end N, and at the opposite end P it is zero. The voltage U is at the highest at the open end, and at the shorted end it is naturally zero. The voltage is at every point 90° ahead of the current (the phases are not shown in the picture), and so the resonator is inductive for its whole length.

Figure 2A:
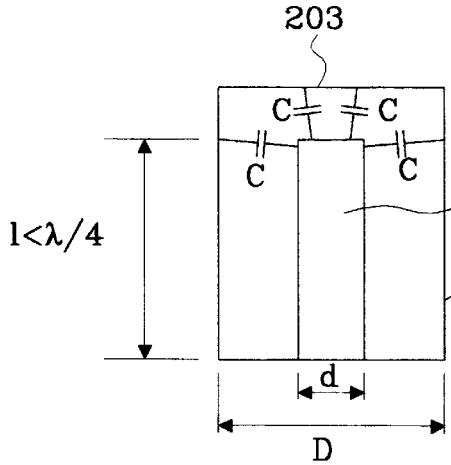
FIG. 2*a* is a schematic illustration of the resonator according to the invention.
Figure 2B:
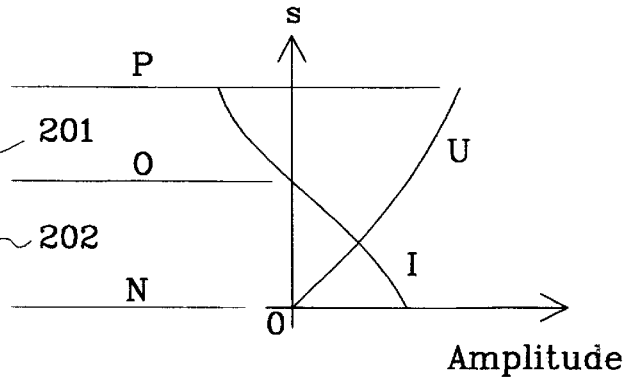
FIG. 2*b* shows the change of the intensity of the current and voltage in the resonator of FIG. 2*a,*

FIGS. 2*a* and 2*b* show the principle of the shortened coaxial resonator according to the invention. Extra capacitance C is arranged to the open end P of the resonator. Parallel to this, there is another resonator, which is inductive because of the shorting out of the opposite end N. The extra capacitance C has a reducing effect on the resonance frequency. In order that the resonance frequency would not change, the inductance must be correspondingly smaller than the inductance of a corresponding, ordinary quarter-wave resonator. The inductance is reduced when the length l of the structure is reduced from the length of the quarter-wave $\lambda/4$. This is due to the fact that when moving from the distance $\lambda/4$ towards the short circuit or the end N, the ratio U/I of the absolute values of the voltage and the current is reduced, which means that the inductance decreases. FIG. 2*b* shows the voltage U and the current I as a function of the location s in a shortened resonator. The voltage U is at the highest at the end P of the extra capacitance of the resonator, and is also reduced to zero when moving to the shorted end N. At the end of the extra capacitance P, the current I has a certain value which is dependent on the size of the extra capacitance. The capacitance forces the phase difference of the voltage and current to be 90° (voltage behind current). When moving towards the shorted end, the current is reduced to zero at point O and then it increases in the opposite phase to a certain value. Because of the phase inversion of the current I, at the shorted end the voltage U is 90° ahead of the current. According to the above description, the resonator is inductive on the distance NO and capacitive on the distance OP. Point O is the further from the resonator end P the higher the extra capacitance, that is, the more the resonator has been shortened.

Figure 3A:
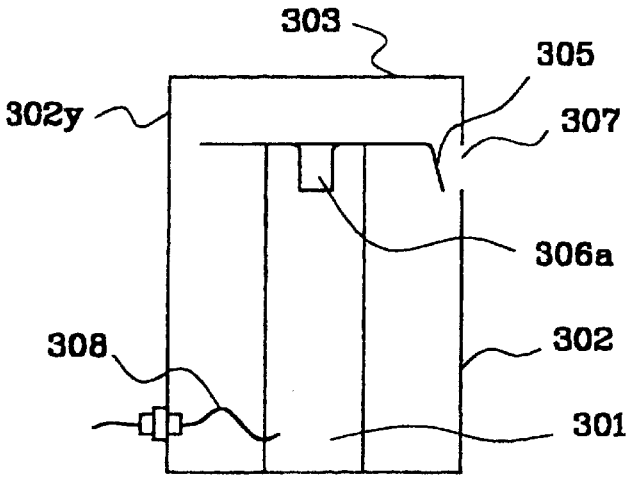
FIGS. 3*a* and 3*b* shows an embodiment of the resonator according to the invention as a vertical and lateral section, respectively
Figure 3B:
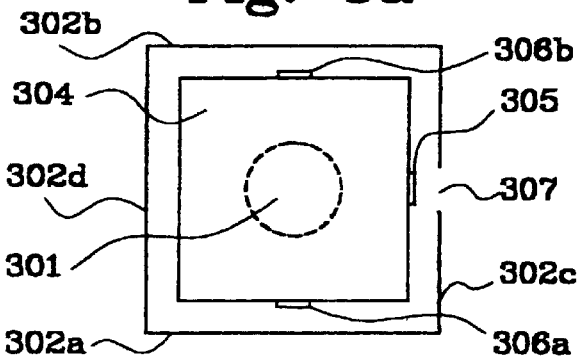

FIGS. 3*a,* 3*b* and 4*a,* 4*b,* respectively show preferred embodiments of the invention. FIGS. 3*a* and 3*b* shows a construction in which a conductor plate 304 is fastened to the end of the inner conductor 301, which conductor plate includes flaps 305, 306*a* and 306*b,* which are folded down. The plate 304 has an essentially larger surface area than the cross-sectional area of the inner conductor, and thus it creates capacitance evenly with the cover 303 of the resonator. In addition, the plate 304 creates a capacitance with the upper part 302*y* of the outer conductor 302. The flap 305 is almost parallel with one wall 302*c* of the outer conductor of the resonator, the flap 306*a* is almost parallel with the wall 302*a,* and the flap 306*b* is almost parallel with the wall 302*b.* Together the flaps 305, 306*a* and 306*b* create capacitance with the outer conductor of the resonator. The surface area of the plate 304 and distances to the walls of the resonator are dimensioned so that due to the extra capacitance created, the resonator can be made substantially smaller.

In the structure of FIGS. 3*a* and 3*b,* the flap 305 is also used for coupling the signal capacitively out of the resonator through an opening 307 in the wall 302*c* of the outer conductor. A separate element used only for coupling is thus not needed. The flaps 306*a* and 306*b* are also used for tuning the resonator: both or one of them is bent a little, until the resonance frequency is exactly the right. Thus a separate mechanism for tuning the resonator is not needed. In the example of FIGS. 3*a* and 3*b*, the signal is coupled to the resonator inductively by a piece of cable 308.

Figure 4A:
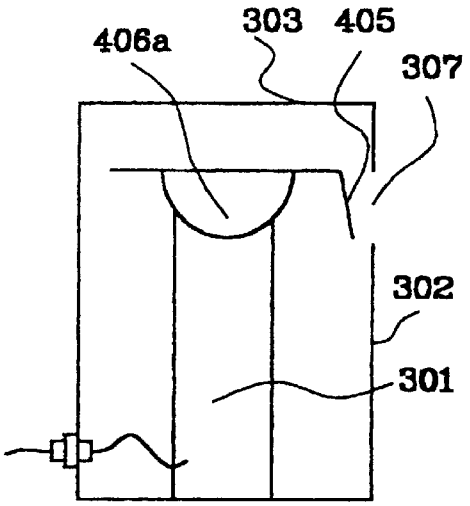
FIGS. 4*a* and 4*b* shows another embodiment of the resonator according to the invention as a vertical and lateral section, respectively.
Figure 4B:
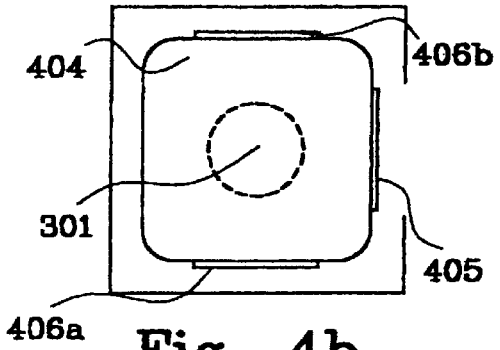

FIGS. 4*a* and 4*b* shows an embodiment of the present invention with an alternative shape of the flaps 405, 406*a*, 406*b* and the plate 404. The shape of these alternative flaps and plate are semilunar and smoother which enhances the characteristics of the resonator due to lower electric and magnetic fields around the edges, and thus, lower dissipation. This feature increases the Q-value compared to the embodiment shown in FIGS. 3*a* and 3*b*.

The plates and the flaps shown in FIGS. 3*a*, 3*b* and 4*a*, 4*b*, respectively, may be made in a single piece of a thin metal sheet, where the main part is the plate and the flaps are made by bending parts of the sheet. The flaps are bent to form approximately a perpendicular angle to the plate.

Figure 5:
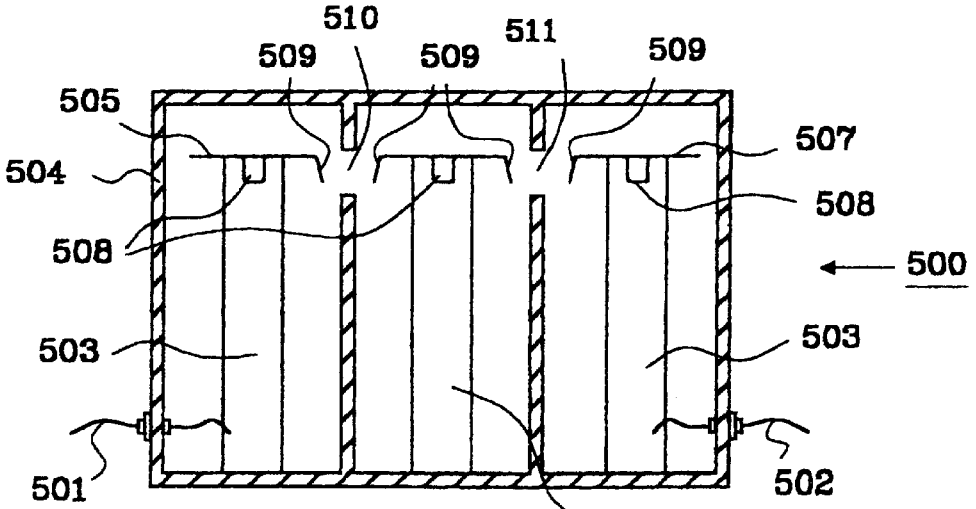
FIG. 5 shows a filter comprising three resonators according to the invention.

FIG. 5 shows a filter 500 comprising a plurality of resonators according to the present invention. The filter also comprises input means 501 and output means 502. Each resonator comprises, in turn, an inner conductor 503, a common outer conductor 504 and suitable conductor plates 505, 506, 507 fastened to the open end of the inner conductor.

Each plate comprises two types of flaps, a first type of flap 508 is used for tuning the frequency of the resonator and a second type of flap 509 is used for coupling the signal to another resonator. The outer conductor is divided into cavities, where one inner conductor is arranged within each cavity.

A signal is connected to a resonator via said input means 501. The inner conductor 503 of said first resonator has a first plate 505, which, in turn, comprises at least one tuning flap 508 and one coupling flap 509. The coupling flap 509 is arranged besides a first opening 510 between the first and second adjacent cavities.

The inner conductor 503 of a second resonator has a second plate 506, which, in turn, comprises at least one tuning flap 508 and two coupling flaps 509. The first coupling flap 509 is arranged opposite the coupling flap 509 on the first plate 505, thus creating a path for said capacitive coupling through said first opening 510. The second coupling flap 509 is arranged adjacent to a second opening 511 between the second and third adjacent cavities.

The inner conductor 503 of said third resonator has a third plate 507, which, in turn, comprises at least one tuning flap 508 and one coupling flap 509. The coupling flap 509 is arranged opposite the coupling flap 509 on the second plate 506, thus creating a path for said capacitive coupling through said second opening 511. The signal is then connected to the output means 502.

The angle of the tuning flaps are individually adjusted through apertures (not shown) in the outer conductor 504 to the precise frequency for each resonator.

Particularly remarkable in the structures of FIGS. 3*a*, 3*b*, 4*a*, 4*b* and 5 is the fact that the manner of using the upper space of the resonator results in the disappearance of the third harmonic frequency component. In these structures, the extension of the inner conductor means, besides the shortening of the resonator caused by the increase of capacitance, also the reduction of resistive dissipation at the end of the extended inner conductor.

What is claimed is:

1. A coaxial resonator, the electrical length of which is a quarter-wave, comprising an inner conductor (301), an outer conductor (302) and a conductive cover (303), which inner conductor (301) is essentially air-insulated from, and in open-circuit relation with, said outer conductor (302) and said conductive cover (303), said outer conductor, in turn, comprises at least one external wall (302*a*, 302*b*, 302*c*, 302*d*), a first end of said outer conductor (302) being short-circuit connected to a first end of said inner conductor (301) and an opposite second end of said outer conductor (302) being covered with said conductive cover (303), which is conductively connected to the outer conductor (302), characterised in that the inner conductor (301) has an extension (304) at an open end, opposite said first end, of the inner conductor, essentially parallel with the conductive cover (303), which extension forms extra capacitance substantially evenly with the conductive cover (303), said extension having at least two projections (305, 306*a*, 306*b*) that are essentially parallel with the external walls (302*a*, 302*b*, 302*c*, 302*d*) of the outer conductor (302), and at least one of said projections forms extra capacitance with an upper part (302*y*) of the outer conductor (302), whereby:

at least one (305) of said projections is a capacitive coupling element for external coupling of the resonator, and at least one (306*a*) of said projections is a tuning element of the resonator.

2. Resonator according to claim 1, characterised in that a free end of each projection extends essentially in a direction towards said first end of the outer conductor.

3. Resonator according to claim 1, characterised in that said extension (304) has an essentially larger surface area than a cross-sectional area of the inner conductor (301).

4. Resonator according to claim 3, characterised in that said extension is a conductive plate (304).

5. Resonator according to claim 1, characterised in that the extension (304) is fastened to the inner conductor (301), which extension (304) is relatively thin.

6. Resonator according to claim 5, characterised in that the extension (304) and the projections (305, 306*a*, 306*b*) is made of a single piece of metal sheet, where each of said projections is a folded part of the sheet.

7. Resonator according to claim 6, characterised in that each of the projections has an essentially semilunar shape.

8. Resonator according to claim 1, characterised in that at least one of the walls (302*a*, 302*b*, 302*b*, 302*c*) of said outer conductor (302) is provided with at least one aperture for tuning of said projections (305, 306*a*, 306*b*).

9. Resonator according to claim 1, characterised in that said inner and outer conductors (301, 302) of the resonator are self-supporting.

10. A filter comprising input means and output means, characterised in that said filter further comprises more than one resonator according to claim 1, provided with an opening (307) between at least two adjacent outer conductors, creating a path for said capacitive coupling from a first resonator to a second resonator.

* * * * *